US005316449A

United States Patent [19]

Vandendorpe

[11] Patent Number: 5,316,449

[45] Date of Patent: May 31, 1994

[54] MOTOR-DRIVEN PUMP WITH REACTION TURBINE

[75] Inventor: Guido Vandendorpe, Knokke-Heist, Belgium

[73] Assignee: N.V. Baggerwerken Decloedt & Zoon, Belgium

[21] Appl. No.: 971,526

[22] Filed: Nov. 3, 1992

[30] Foreign Application Priority Data

Nov. 14, 1991 [EP] European Pat. Off. ..... 91870183.0

[51] Int. Cl.[5] ..... F04D 13/04; F04D 3/02; F04C 11/00

[52] U.S. Cl. ..... 417/355; 417/409

[58] Field of Search ..... 417/355, 408

[56] References Cited

U.S. PATENT DOCUMENTS

| | | | |
|---|---|---|---|
| 1,165,794 | 12/1915 | McClure | 417/355 |
| 2,761,617 | 9/1956 | Van Orneim | 417/355 |
| 3,330,213 | 7/1967 | Donadson | 417/355 |
| 4,008,983 | 2/1977 | Flatt | 417/355 X |
| 4,913,631 | 4/1990 | Vandendorpe | 417/355 |

FOREIGN PATENT DOCUMENTS

| | | | |
|---|---|---|---|
| 0330640 | 8/1989 | European Pat. Off. . | |
| 466165 | 8/1927 | Fed. Rep. of Germany | F04D 13/04 |
| 3008334 | 2/1982 | Fed. Rep. of Germany . | |
| 0465413 | 12/1968 | Switzerland . | |
| 553334 | 8/1974 | Switzerland | F04D 13/96 |

OTHER PUBLICATIONS

Soviet Inventions Illustrated, Sep., 1971, Derwent Publications Ltd., London, GB & SU-A-280,232, May 27, 1969, Bul. 27/26-08-1970.

*Primary Examiner*—Richard E. Gluck
*Attorney, Agent, or Firm*—Ladas & Parry

[57] ABSTRACT

The invention relates to motor-driven pumps (1) with turbine, driven by a fluid at high pressure, and more specially intended for the pumping of liquids and of laden liquids. The motor-driven pump (1) according to the invention comprises a rotating sleeve (15) mounted in line between two fixed rings (13, 14). To the internal surface of the sleeve (15) are secured pumping members (31, 32) such as helical vanes. The outer surface of the sleeve (15) forms the rotor of a turbine into which a pressurised fluid is injected radially in a centripetal manner, from a distribution volute (8).

15 Claims, 5 Drawing Sheets 1
8
9
3
6
22c
22b
30
21
20
21a
22
2
4
7
5
10
11
12
13
14
15
16
17
17a
18
19
23
24
25
26
27
28
29
31
32
33
34

35
8
9
6
7
4
30
30
10
11
2
2
24
24
14
13
40
39
38
16
15
17
36
37
41
19
36
21
21
8

MOTOR-DRIVEN PUMP WITH REACTION TURBINE

FIELD OF THE INVENTION

The invention relates to a motor-driven pump with reaction turbine actuated by a pressurised fluid for the pumping of liquids or of liquids laden with solids.

BACKGROUND OF THE INVENTION

Motor-driven pumps with rotary pump and turbine drive are already known. These motor-driven pumps are distinguished not only by the types of pumps used and by the model of the turbine, but also by the mutual arrangement of the turbine and of the pump, and ipso facto, by the mechanical transmission of the movement between these two constituent parts of the motor-driven pump.

Motor-driven pumps are known, in particular, in which the turbine and the pump are disposed in line, that is to say that the axis of the pump and the axis of the turbine are placed in the extension of one another. In such motor-driven pumps, at least one of the two (inlet and outlet) pipes of the pump is disposed perpendicularly or obliquely relative to the axis of the pump, whereas the second pipe is disposed either perpendicularly or obliquely relative to the axis of the pump, or in line with the axis of the pump (on the side of the pump located opposite the turbine).

Application DE-A-3,008,334 describes a tangential turbine driving a pump the rotary body of which is formed by the hollow shaft of the turbine; the machine described in Application DE-A-3,008,334 operates with steam; the machine described is bulky and adapted solely to a static use.

Document CH-465,413 describes a single-axis pump intended for a fixed installation in an atomic power station. The pump is actuated by a peripheral turbine. The pump rotor is of the type with central hub, supported by bearings which encroach on the available cross-section, without possible mixing between the motive fluid and the pumped fluid.

U.S. Pat. No. 2,113,213 describes cylindrical pumps formed by a small rotary pump and by a concentric turbine. These pumps are intended to operate in wells in order to extract water or oil therefrom. These pumps, mounted in series, are placed in a chamber and sunk under the layer to be pumped. Each pump is provided at its base with vents. When a pressurised fluid is injected into the chamber, it rises through the vents, setting the turbine in rotation and thus actuating the pump. The motive fluid subsequently mixes completely with the pumped liquid in order to rise to the surface.

For some applications, the motor-driven pumps known at the present time all have serious disadvantages; this is especially true of submerged motor-driven pumps used for dredging operations.

In suction dredgers, the boom is equipped with a suction pipe intended for conveying the dredged materials (mud, and/or sand) into the wells of the dredger or into delivery pipes.

Suction can be carried out by a motor-driven pump mounted on board the dredger. However, such a system is suitable only for relatively small dredging depths.

For dredging at greater depth, it is usually necessary to employ a submerged motor-driven pump mounted as low as possible on the suction pipe.

Such a submerged motor-driven pump thus works under pressure, and therefore its suction performance is improved. However, the use for such applications of the motor-driven pumps known at present presents very serious technical problems due in particular to the high weight and large bulk of these motor-driven pumps and of the elbowed pipes connected thereto. Thus, a submerged motor-driven dredging pump which can be connected to pipes of a diameter of 650 mm currently represents a weight of the order of 25 tons, a length of 6 m and a lateral dimension of 3 m (including the elbowed pipes and the frame necessary in order to absorb the stresses generated during manoeuvring and operation). The manoeuvring of a dredging head equipped with such a motor-driven pump of known type requires the use of heavy and costly handling machinery, and a great deal of skill.

Another problem arises because of the (mechanically speaking) difficult environment in which these motor-driven pumps have to be used, namely generally aggressive water, such as seawater, laden with salt and with particles of varied granulometry.

In order to protect the delicate parts of these motor-driven pumps, sealing devices of extremely high performance are generally employed, particularly in order to protect the rolling bearings and the elements of the turbine, thereby proportionately increasing the weight and bulk and also presenting problems of cost, of ease of maintenance and of heat dissipation.

The same inventor's Patent EP-0,033,640 describes a motor-driven pump with turbine actuated by a pressurised fluid more particularly adapted to dredging operations in which the pump and the turbine are disposed in a concentric manner, the motive fluid and the pumped liquid passing through the motor-driven pump in an axial direction. A motor-driven pump, in accordance with EP-0,330,640, despite its qualities, does not yet solve all the problems. In comparison with its power, it is still fairly voluminous and extended in length, which implies a high cost (in weight of metal), and the use of relatively costly handling machinery; it necessitates a high volume of motive fluid and therefore feed pipes of large diameter, entailing a substantial extra weight. Its size still renders it sensitive to the stresses generated during manoeuvring and in service. Furthermore, disassembly of the various members still requires a non-negligible time whereas, precisely, in the working conditions to which it is subjected, these disassemblies are relatively frequent. Lastly, the range of regulation of such a motor-driven pump is, in practice, fairly narrow, which does not make it possible to adapt in an optimal manner to all circumstances arising in service (increasing the load, fitting pumping members of a different kind).

The motor-driven pump according to the invention, which will be described below, can be used in particular as a submerged motor-driven pump and is in particular highly advantageous as a submerged motor-driven pump for dredging and for working marine sediments at great depth. However, the application of the motor-driven pump according to the invention is by no means limited to these particular examples, and it can also be used advantageously as a non-submerged motor-driven pump for pumping various liquids or liquids laden with solids (for example, suspensions of ores and/or coal in water).

An endeavour has been made to construct a motor-driven pump having, for an equal suction power, greater compactness in length and a weight reduced in comparison with what was known in the state of the art.

Another object of the invention is to obtain a very strongly built motor-driven pump, self supporting by virtue of its structure per se, and resisting axial stresses and torsion and flexion alike.

Another object of the invention is to produce a motor-driven pump which permits easy control of the turbine speed and, thereby, of the flow rate and of the pressure of the pumped liquid.

The invention also has as its subject a motor-driven pump of lesser production cost, for equal power, than what is known in the state of the art.

Another object of the invention is to produce such a motor-driven pump which can be used advantageously for the pumping of liquids heavily laden with solids and consequently being suitable as motor-driven pumps for dredging or for working sea bed sediments.

In addition, the invention has the object of providing such a motor-driven pump in which the energy losses are reduced in a substantial manner.

Another object of the invention is to construct a motor-driven pump the bearings of which are protected in an effective manner with regard to their conditions of use.

Lastly, another subject of the invention is a motor-driven pump of low maintenance cost the members of which can easily be replaced.

BRIEF SUMMARY OF THE INVENTION

The invention has as its subject a motor-driven pump with turbine driven by a pressurised fluid, and rotary pump intended for the pumping of liquids and of liquids laden with solid particles, which comprises:

- a fixed pump body comprising a tube end constituting a cylindrical suction port and a tube end constituting a cylindrical delivery port, these two tube ends, of same internal diameter, being disposed in line with one another;
- a cylindrical sleeve, of internal diameter substantially equal to that of these two tube ends, mounted in line between these tube ends, with a slight clearance with respect to the latter, this sleeve being adapted to rotate about its axis, rotary pumping members being mounted inside this sleeve and being securely attached to the latter;
- a drive turbine actuated by pressurised fluid, mounted in ring configuration around the sleeve, a rotor supporting the vanes of the turbine being mounted on the outside of the sleeve and being securely attached to the latter;
- injection means permitting the injection of a fluid into the turbine and expulsion means permitting the discharge of this fluid out of the turbine;
- a casing which locks the fixed body of the turbine with the fixed pump body and forms an annular space around the assembly formed by the sleeve and the two pipes.

In this motor-driven pump, the turbine is a reaction turbine which comprises a rotor which widens on the injection side and then becomes progressively narrower towards one of its ends; this rotor supports vanes which extend on the side of the injection of the pressurised fluid, substantially in the radial direction and on the side of the discharge of this fluid, substantially in the axial direction, while showing, however, a slight divergence from this axial direction;

- the injection means are disposed in ring configuration around the turbine and comprise a distribution ring secured to the casing in an easily detachable manner;
- the casing comprises two cylindrical elements assembled end-to-end in an easily detachable manner;
- regulation means adapted to deviate the flow of pressurised fluid are disposed on the periphery of the turbine, between the distribution ring and the rotor.

According to an advantageous embodiment, the motor-driven pump comprises a rotor with a single serials of vanes, the means for expulsion of the pressurised fluid being located on the side of the delivery port.

According to another advantageous embodiment, the motor-driven pump comprises a rotor formed with two series of vanes, with their inlets conjugate, the expulsion means of one of these rotors being located on the side of the delivery port, the expulsion means of the other rotor being located on the side of the suction port.

In a preferred manner, annular seals are disposed between the sleeve and the tube ends, these seals being adapted to prevent the passage of pumped liquid and of particles from the interior of the sleeve to the annular space constituting the interior of the casing without impeding the rotation of the sleeve.

The annular space constituting the interior of the casing is advantageously subdivided, on either side of the sleeve, into two chambers separated by a rotary seal, the first chamber being separated by an annular seal from the interior of the pump, the second chamber opening onto a bearing, this second chamber being disposed on the passage of the pressurised fluid escaping from the turbine and adapted to be placed in slight overpressure with respect to the first chamber, so as to prevent the passage of pumped liquid, laden with solid particles, to the bearings.

The cylindrical elements are preferably extended in the direction of their common end, by a flange extending outwards.

According to a preferred embodiment, the regulation means comprise adjustable blades and fixed deflectors.

The rotary pumping members comprise, according to a well tried embodiment, helical vanes (developing from the internal surface of the sleeve and directed towards the axis of the latter).

According to one construction of the above embodiment, an empty space extends between the axis of the sleeve and the vanes.

According to another construction, the said vanes connect with one another along a line which coincides with the axis of the sleeve.

According to another embodiment, the rotary pumping members comprise an Archimedean screw.

In yet another embodiment, the rotary pump is a Moineau pump, the outer part of which is securely attached to the internal surface of the sleeve and disposed along the axis of the latter, one of the ends of the central part, engaged in the outer part, being secured by a coupling to a shaft, the other end of this shaft being attached, also by a coupling, to a bracket securely attached to the fixed pump body.

Another subject of the invention is a device for removing sediments from sea, river or lake beds, mounted on a dredging machine and comprising a boom, one end of which, intended to be submerged, is fitted with a head, and at least one motor-driven pump connected to the said boom; this device comprises at least one motor-driven pump in accordance with what has been described above, which is connected to the boom close to its submerged end; the axis of rotation of these or this motor-driven pump(s) coinciding with the axis of the boom so that the pumped sediments do not undergo any change of axial direction while rising towards the other end of the boom.

This device may be installed on a dredger vessel, for example, whether it has a trailing boom, is stationary or at a fixed point, or with a disintegration means. It may also be used on a vessel for mining nodules at great depth.

One advantage of the turbopump according to the invention lies in its reduced weight compared with other machinery performing the same function, with equal characteristics.

Another advantage is that the speed of the turbine can easily be adjusted, which renders possible a precise control of the dredging operations.

Yet another advantage is that, in view of the possible variations in the torque and in the speed of the turbine, the motor-driven pump can be fitted with a large variety of different pumps, depending on the applications.

Another advantage is that the motor-driven pump can be disassembled and reassembled easily, which makes it possible to check the state of wear of the parts in a minimum time.

Another advantage is that, because of the presence of a double partitioning by "clean" fluids between the bearings and the pumped water, laden with solid particles, the bearings have the benefit of a very long life.

Another advantage is that the turbine is actuated by a fluid at high pressure, with the result that the volume of fluid used, and therefore the size of the feed pipes, can be reduced.

Another advantage is that the motor-driven pump can be used in all positions and at any angle.

Another advantage, somewhat unexpected, is that cavitation phenomena are found to be almost absent in the turbine and even in the pump (depending on its type and depending on the depth of operation), which has a very favourable effect on the life of the turbopump.

Lastly, an appreciable advantage is that the turbine with its pump offers a very high overall efficiency (of the order of 72%) over a wide range of speed.

BRIEF DESCRIPTION OF THE VARIOUS FIGURES

Other features and advantages of the invention will become apparent from the description of particular embodiments described below, in this case, two motor-driven pumps for dredging, given as non-limitative examples, with reference to the accompanying drawings, in which.

DETAILED DESCRIPTION

Figure 1:
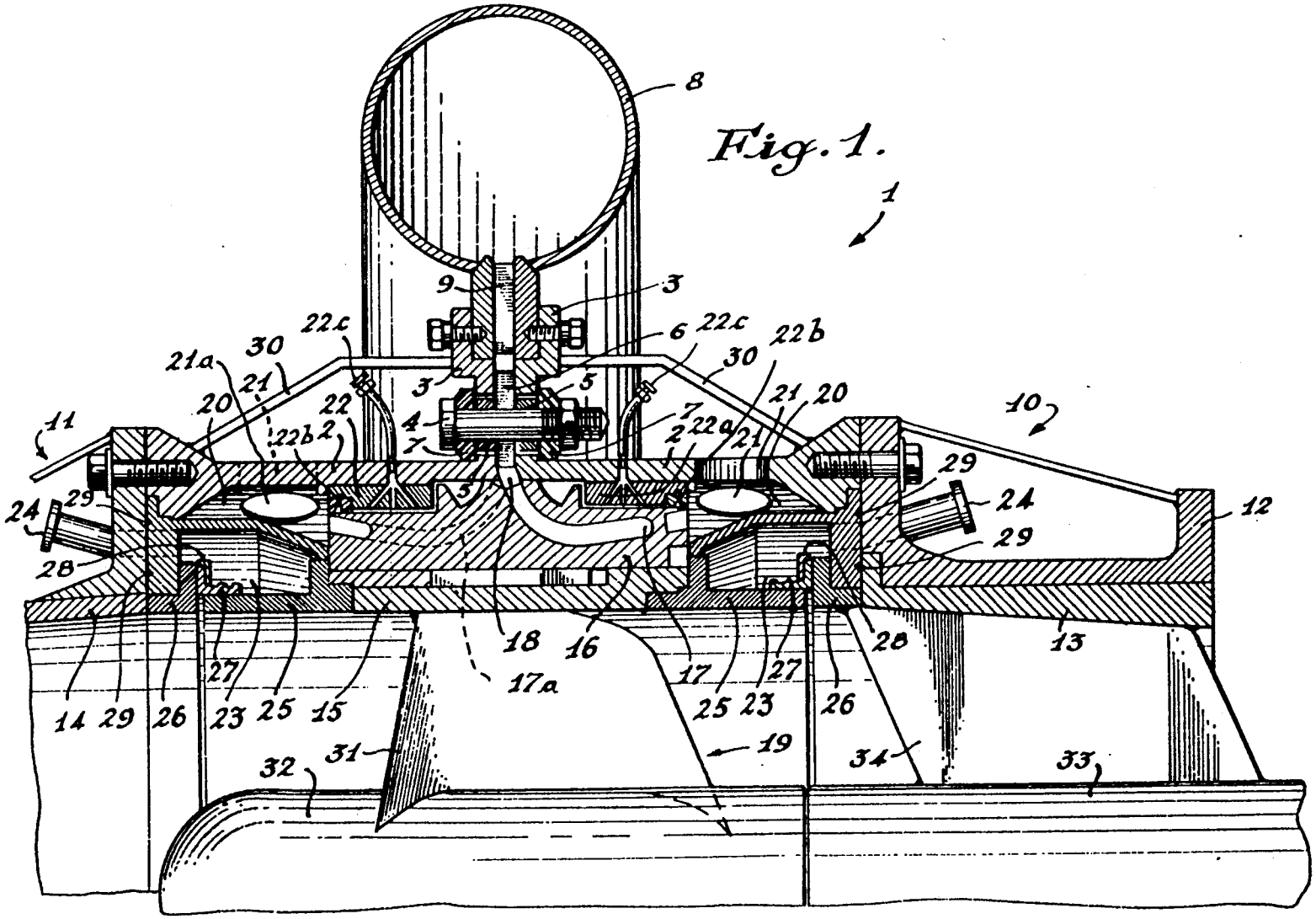
FIG. 1 is a side view, partially in cross-section, of a motor-driven pump according to the invention fitted with a pump with vanes and a turbine including two series of turbine vanes.

The motor-driven pump 1 shown in FIG. 1 comprises a casing formed essentially of two cylindrical elements 2. These elements 2 are joined to one another with a slight gap by flanges 3 extending outwards. This union is produced by assembly means, namely in this case bolts 4. Each bolt 4 is mounted on bushes 5, which allows the bolt to pivot after tightening. Each bolt 4 supports, at its middle, a movable blade 6 and can be turned by the intermediary of pivoting washers 7 actuated by a pivoting device (not shown).

The two cylindrical elements 2 and their flanges 3 form the stator of an easily detachable turbine. A volute-shaped distributor 8 for distributing pressurised fluid is secured to the periphery of the stator, around the gap between the two flanges 3.

Fixed deflectors 9 are disposed between the flanges 3 so that the fluid is orientated in an optimal manner, the movable blades 6 allowing the angle of attack of this fluid to vary and therefore the speed of the turbine to vary.

The free ends of the cylindrical elements 2 are each secured by bolts to a conical inlet, or outlet part 10, 11 comprising a mounting flange 12 at its end of smaller diameter. This mounting flange 12 makes it possible to connect the motor-driven pump 1 to suction and delivery pipes (not shown). To the internal surface of these conical parts is secured an annular part 13, 14, these annular parts 13, 14 constituting the suction and delivery ports of the pump and also the fixed part of the pump. These parts 13, 14 converge slightly towards their end in order to give the pump 1 an optimum efficiency.

Between these two annular parts 13, 14 is disposed a sleeve 15 aligned along the same axis as these annular parts 13, 14 and having at its ends substantially the same internal diameter as these annular parts 13, 14.

This sleeve 15 is an element common both to the pump and to the turbine, which constitutes at the same time the boundary between these two essential parts of the motor-driven pump and the transmission between these two parts.

The rotor 16 of the turbine with its vanes 17 is secured to or forms part of the external surface of the sleeve. The vanes 17 extend from a part of the rotor 16 of larger diameter located facing the inlet 18 (which is disposed radially) along a double curvature as far as a part of this rotor 16 of smaller diameter where the said vanes 17 are disposed substantially axially, which enables energy to be recovered from the fluid under high pressure with a very high efficiency. The slightly divergent shape of the vanes 17 as they approach the discharge chamber will however be noted.

Thc rotor 16 shown in FIG. 1 constitutes "double-rotor", that is, a rotor provided with two series of coupled vanes 17 and **17*a*, wherein a vane 17*a* is shown in dotted lines, the series of vanes 17*a* comprising two series of coupled vanes 17, one pointing in the axial direction, on the same side as the inlet port 14 of the motor-driven pump 1, the series 3 vanes 17 pointing in the axially opposed direction. This configuration has the advantage of practically balancing the axial thrust generated by the pressurised fluid on the rotor 16**.

Figure 5:
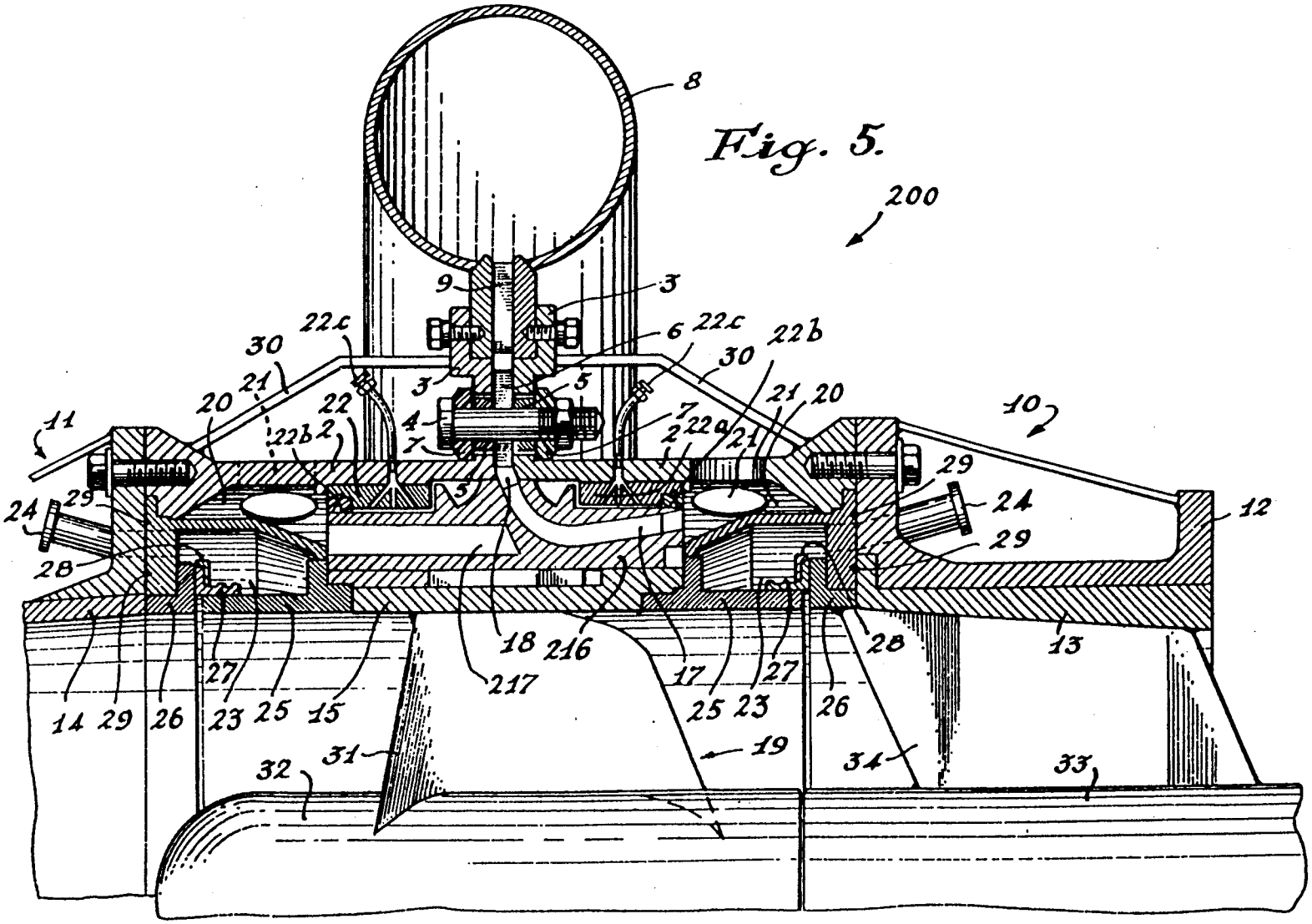
FIG. 5 is a side view, partially in cross-section, of a motor-driven pump according to the invention fitted with a pump with vanes and a turbine including one series of turbine vanes.

FIG. 5 shows a motor-driven pump 200 with a rotor 216 including a single series of vanes 17. In this embodiment, the rotary mass can be lightened by making blind holes therein to provide dynamic balance of the rotor in movement. The discharge is disposed on the same side as the delivery port 13 of the pump, so as to create on the rotor 216 a thrust opposed to that generated by the pumped liquid on the pump rotor.

When the motor-driven pump 1 or 200 is in operation, the volute-shaped distributor 8 is supplied with a fluid under high pressure. This fluid is distributed around the turbine and escapes in centripetal manner between the two flanges 3.

Guided by the deflectors 9 and the blades 6, the pressurised fluid reaches the vanes or 17*a* to which it imparts a thrust causing the rotation of the sleeve 15, and, thereby, of the pumping means 19 which are secured to the internal surface of the sleeve 15.

The motive fluid is released after use into two discharge chambers 20 disposed on either side of the turbine.

The calibrated ports 21 and 21*a* are pierced over the entire periphery of these chambers 20 so as to allow the pressurised fluid to escape while maintaining inside these chambers a slight overpressure in comparison with the ambient medium.

Axial bearings 22 and radial bearings 22*a* and their seals 22*b* are located at the outer periphery of the sleeve 15. These members are lubricated by a particularly cleansed and centrifuged proportion of fluid admitted under pressure by supply ducts passing through the axial bearings 22 and radial bearings 22*a* and fed by external pipes 22*c* fed by a pump (not shown), which may moreover, as required, be located at the surface; the injection of lubricating fluid at separate points makes it possible for the rotor 16 of the turbine to "float" literally and to remain centred in a sable manner on the centre of rotation of the movable part.

These axial bearings 22 and radial bearings 22*a* and their seals 22*b* pierced by supply capillaries are located out of reach of the liquid laden with particles which passes through the pump. In order to arrive at the bearings 22 and 22*a*, this liquid would have in fact to pass through a double fluid barrier. The bearings 22 and 22*a* are in fact contiguous to the two discharge chambers 20 of the turbine. The surrounding fluid, at an overpressure, creates a first protection for these bearings 22 and 22*a*.

Each discharge chamber 20 communicates via a sliding contact with a second chamber 23 which is itself in overpressure with respect to the interior of the sleeve 15. This overpressure is obtained by the presence of a connecting pipe 24 opening into the second chamber 23 to which is connected a water pump (not shown). The "clean" water feeding this pump is tapped from the environment (at the level of the conical elements 10, 11 or further away, or even at the surface). This water is injected into the second chambers 23 at a pressure higher than that prevailing in the pump body in normal conditions at the place where the chambers 23 are located; it will be noted that this pressure will not be identical depending on whether the location is on the "upstream" side or on the "downstream" side of the pump and that the pressure in these chambers must therefore vary accordingly.

The gap separating, on each side, the rotating sleeve 15 from each annular part 13, 14 is closed by a rotating sleeve 25 which simultaneously performs the function of a rotating seal and of a pumping seal by virtue of its configuration (which comprises helical grooves). Facing these rotating sleeves 25 at the inlet port 14 and outlet port 13 of the pump, fixed wearing seals 26. Supple seals 27, each secured by a gripping ring 28 and by bolts, ensure the closure of the space subsisting between the rotating sleeves 25 and the fixed wearing seals 26. These seals 25, 26, 27 of a well-known type, prevent the migration of particles from the pumped liquid to the second chamber 23 and from there to the axial and radial bearings 22, 22*a*.

O-rings 29 of different diameters are disposed between the various parts of the stator (for example, between the cylindrical elements 2 and the two conical suction and delivery parts 10, 11 respectively). the provision of the O-rings makes it a much easier assembly of the motor-driven pumps especially for the dredging pump.

Reinforcement structures 30 extend between each flange 3 and the corresponding cylindrical member 2; the motor-driven pump 1 thus equipped is highly resistant at the same time to the tensile stresses and to the torsional moments liable to occur in extreme operating conditions The fitting of such reinforcement structures 30 consisting of spacers or of sheet metal elements is however optional when the pump is not working in demanding conditions. The second part of the motor-driven pump 1 is constituted by the pump itself which consists of pumping means 19 mounted inside the sleeve (that is to say, as shown in FIG. 1, of the helical vanes), the pump comprising a movable part (the sleeve 15 and the vanes 31) and a fixed part (the fixed suction and delivery rings 13, 14).

The vanes 31 of the motor-driven pump can be seen to be connected towards the centre of the internal space of the pump to a spindle-shaped hub 32. The back of this spindle-shaped hub 32 is connected to a hydrodynamic extension 33 held- by blade-shaped brackets 34 secured to the delivery part 13.

The advantage of the motor-driven pump 1 is that the energy of the motive fluid is transmitted without mechanical losses due to a coupling or to a speed reducer directly to the pump; in addition, by virtue of the turbine, the risks associated with the use of electricity in a marine environment or in damp places (inherent in pumps with electric motors) are eliminated.

Figure 2:
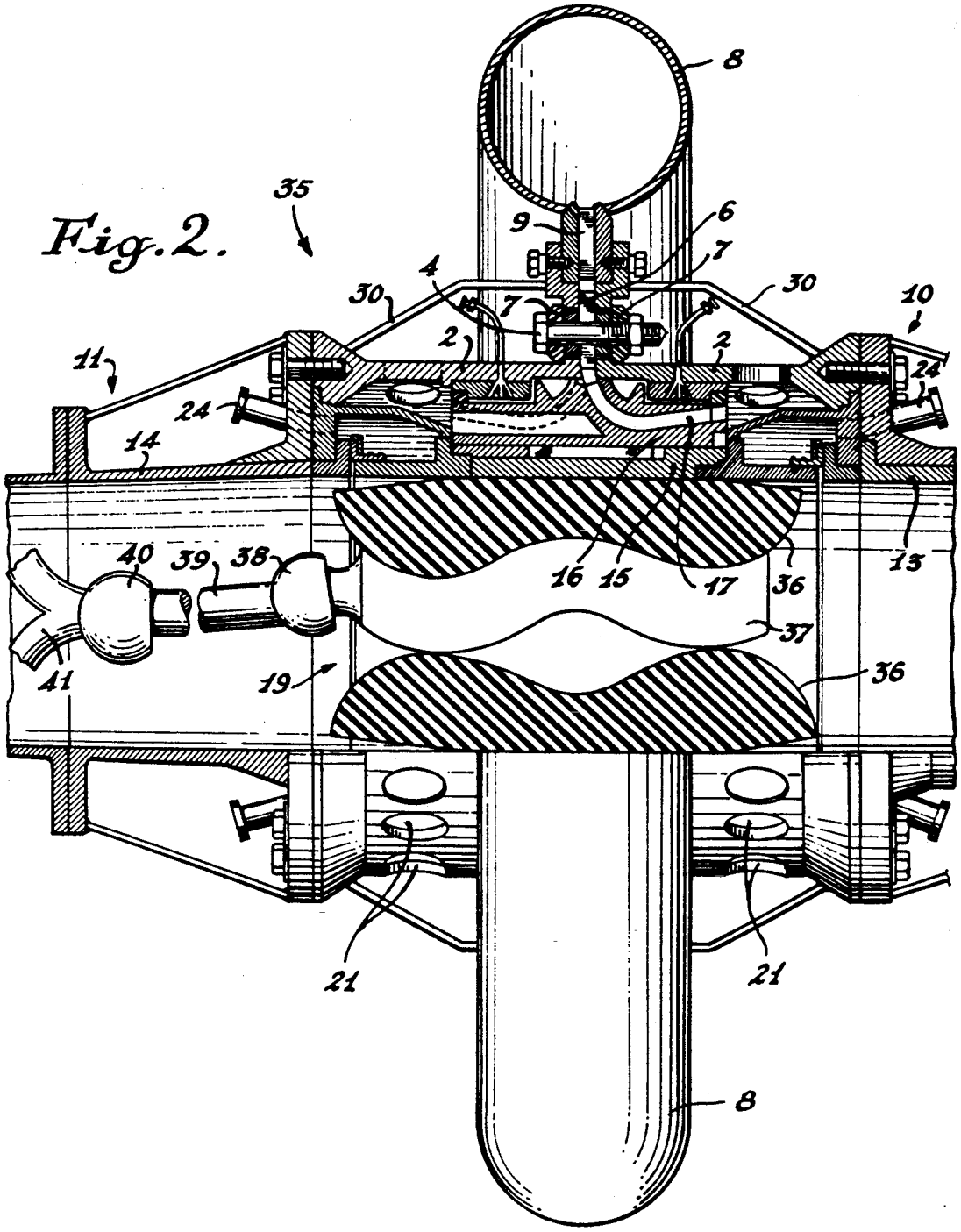
FIG. 2 is a side view, partially in cross-section, of a motor-driven pump according to the invention, fitted with a Moineau pump.

FIG. 2 shows a motor-driven pump 35 similar to the motor-driven pump 1 shown in FIG. 1, but fitted with a "reversed" Moineau pump and not with a pump with vanes.

The outer part 36 of the Moineau pump is secured to the inside of the rotary sleeve 15.

The central part 37 of the Moineau pump is secured, by the intermediary of a coupling 38, to the end of a shaft 39 which, by its other end, is connected by the intermediary of a coupling 40 to a fixed bracket securely attached to the suction pipe.

A motor-driven pump 35 fitted with a Moineau pump is particularly advantageous for the pumping at constant flow rate, under high pressure, of viscous mixtures such as muddy or clayey mixtures.

Figure 3:
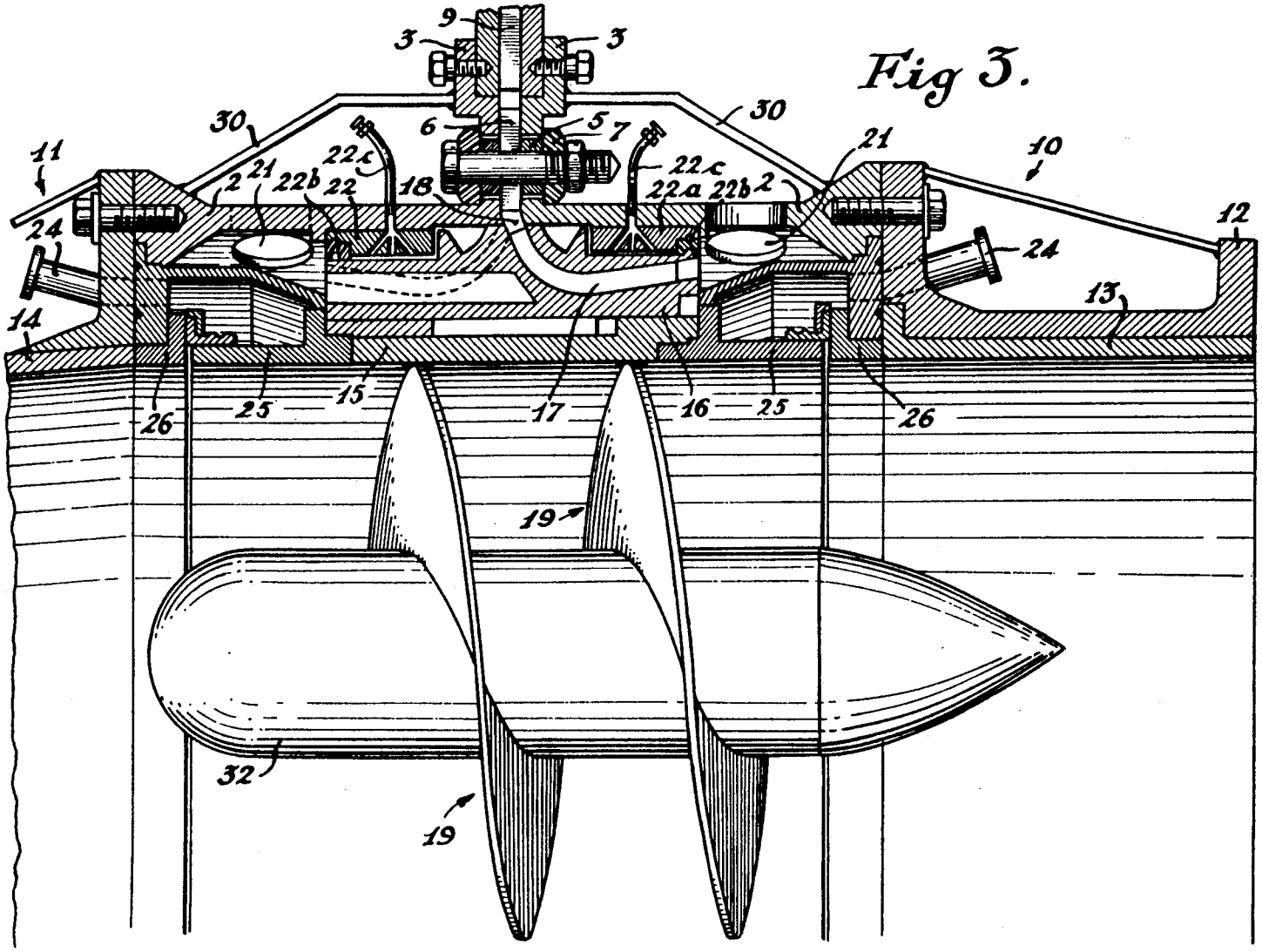
FIG. 3 is a side view, partially in cross-section, with localised cutaway, of a motor-driven pump fitted with a pump with Archimedean screw.

FIG. 3 is a view in cross-section of an embodiment of the turbopump in which the pumping means have the form of an Archimedean screw. The motor-driven pump can be seen to lend itself to the installation of a wide variety of pumps of rotary type.

Figure 4:
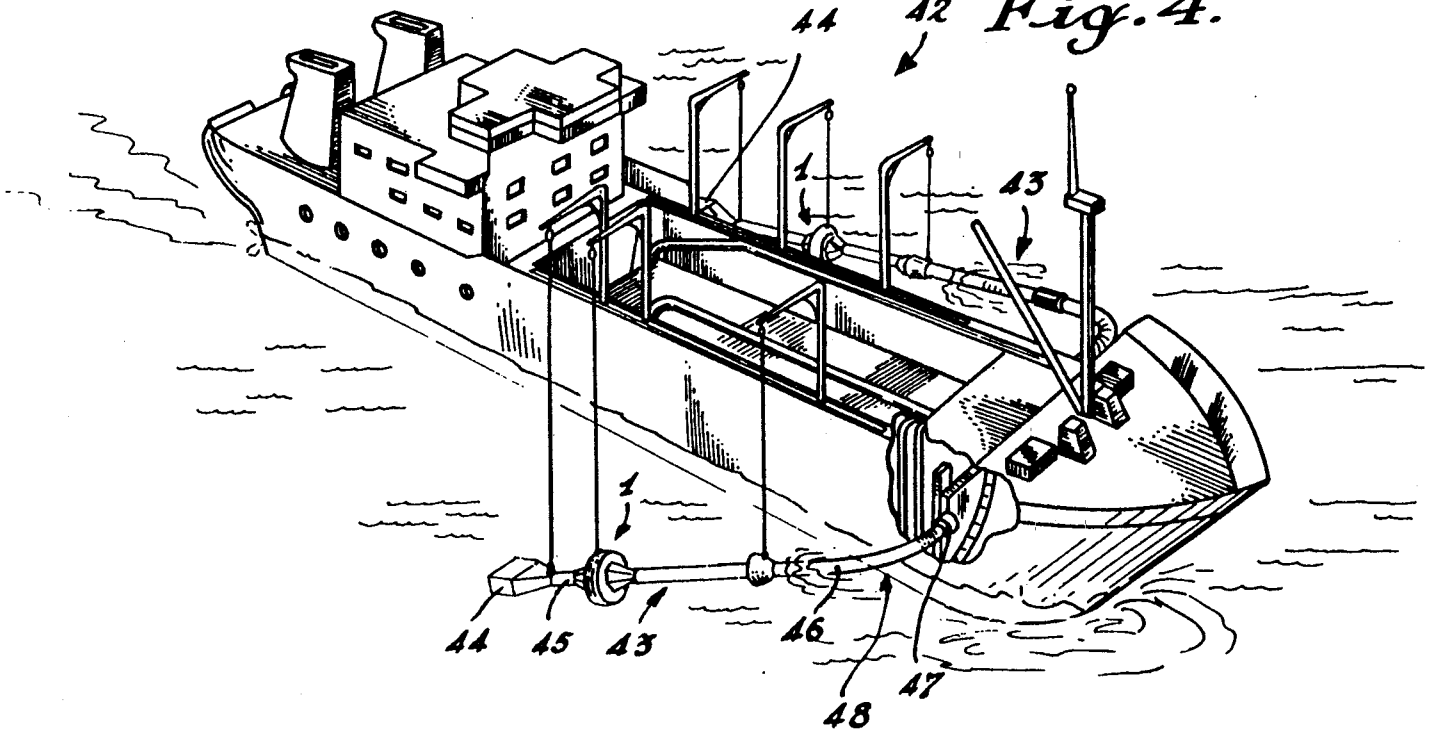
FIG. 4 is a diagrammatic view of a dredging device according to the invention.

FIG. 4 shows diagrammatically a type of dredger vessel 42 fitted with dredging devices 43 in line according to the invention.

One dredging device 43 is disposed on the port side, in raised position for transport.

A second device 43 is in place, lowered towards the bottom. Each device 43 comprises a strainer 44 which is brought down onto the bottom to be dredged. This strainer 44 is connected to a secondary boom 45. This secondary boom 45 is connected to the suction port of a motor-driven pump according to the invention. The latter is constantly "under load" and sends the liquid drawn up via the main boom 46 back towards the suction pump 47 located on board of the dredger vessel 42. Depending on the power of the pump according to the invention, this suction pump 47 may simply be omitted. If justified by the depth or the density of the pumped liquid, it is perfectly possible to place a second pump 1 in line behind the first. From the strainer 44 to the elbow 48 for connection to the suction pump 47, the laden liquid encounters practically no change of direction; the pressure losses due to friction are therefore reduced to a minimum; in fact the particles of the mixture remain in suspension by virtue of the disturbance provided by the pump, the greater part of the energy serving to cause the sludges to rise from the bottom up to the dredging well. Practically no wear occurs due to the localised and concentrated impact of particles (as in the case where centrifugal pumps are employed).

Although the motor-driven pump according to the invention has been described in the context of an application to dredging, it can also be used for other applications with different types of rotary pumps whenever it is required to reduce the overall dimensions of a pump and of its drive system, or when it is a question of working in difficult conditions from the maintenance point of view, with liquids laden with salts or with mineral particles (coal, sand, diamond bearing muds, etc) and particularly in mines, for the transport of waste water, etc.

The boom, 45, 46 and the pump (or the pumps) being aligned along the same axis, the damage caused by larger debris is also limited.

One particularly advantageous point is the fact that, within a medium particularly testing for the equipment, in this case the saline and corrosive marine environment, the dredger pump uses precisely the surrounding liquid, laden moreover, in order to actuate and to lubricate the moving parts. Its design and its maintenance are thus considerably simplified and an extended duty factor is obtained.

This concept is also advantageous as far as protection of the environment is concerned: there is, in fact, no input of other liquids of different composition capable of giving rise to a disturbing effect on the surroundings; furthermore, the liquid used is not contaminated by the presence of residues of lubricants, since these polluting products are simply not used in the pump.

It is also found that the pump I being in the axis of the booms 45, 46, withstands much better the stresses generated by the handling operations (shipment, unshipment) and the operation (catching, immobilisation of the strainer at the bottom due to suction effect, effect of unevenness).

Its design is very light because of its single casing, because of the absence of couplings and of fragile parts to be protected. It is thus easy to use such a dredging device operating at very great depths, taking care each time to couple two motor-driven pumps rotating in opposite directions so as to avoid the effects of torsion (due to the torque of the turbines) on the boom 46. The possibility of working with lifting machinery of relatively small carrying capacity is also a major economic factor. This capability which the pump has of working even at very great depth, without concern for maintenance or sealing problems, allows it to be successfully used for marine works as special as the mining of nodules. In this case, the boom is held vertical and comprises a number of concentric pumps 1 sufficient to ensure the transport to the surface of nodules taken from the sea bed. Here, too, care is taken to cause the pumps to rotate, two by two, in opposite directions so as not to subject the boom to any excessive torsional force when starting up or when changing the speed of the turbines.

The technical shut-down time of such a pump is also greatly reduced: its design is by definition extremely strong and the parts subject to wear can be easily replaced without complete disassembly of the turbine and of its structure.

I claim:

1. A motor-driven pump including a turbine driven by a pressurized fluid and a rotary pump for pumping liquids and liquids laden with solid particles comprising:

a fixed pump body including two cylindrical end members of the same internal diameter, which constitute respectfully a suction port and a delivery port, said two cylindrical end members being spaced apart and disposed in line with one another;

a cylindrical sleeve of an internal diameter substantially equal to that of the two end members, said sleeve being rotatably mounted in line with and between the two end members and adopted to rotate about an axis thereof;

rotary pumping members of the rotary pump being mounted inside and secured to the cylindrical sleeve;

two cylindrical casing elements being assembled together at one end thereof, and with the respective other end fixed to the two end members of the fixed pump body, said two casing elements constituting a turbine casing for accommodating the rotatably cylindrical sleeve, thereby defining an annular space between each end of the sleeve and one of the end members;

a rotor of the turbine being mounted in ring configuration around the sleeve and secured thereto, said rotor including at least one series of vanes and having a portion of large diameter extending between two portion of smaller diameter, said vanes being formed on a curved surface of the rotor, each vane including a substantially radial inlet part disposed along the large diameter poriton of the rotor and a substantially axially diverting outlet part disposed along one of the smaller diameter portion of the rotor;

injection means being disposed in ring configuration around the turbine casing and including a distribution volute secured to the casing in an easily detachable manner, said injection means permitting a centripetal injection of the fluid into the turbine and including an injection inlet disposed towards the radial inlet parts of said vanes;

regulation means being disposed on the periphery of the turbine casing between the distribution volute and the rotor, said regulation means adopted to divert the injection flow of the fluid; and discharge means being disposed in the turbine casing between the axial outlet parts of said vanes and one of the end members of the fixed pump body.

2. The motor-driven pump according to claim 1, wherein the outlet parts of the vanes are disposed along one of the smaller diameter portions of the rotor towards the delivery port, the discharging means being located adjacent to the delivery port.

3. The motor-driven pump according to claim 1, wherein the rotor supports a first and a second series of vanes, the outlet parts of the first series of vanes being disposed along the smaller diameter portion of the rotor towards the delivery port, the outlet parts of the second series of vanes being disposed along the smaller diameter portion of the rotor towards the suction port.

4. The motor-driven pump according to claim 1, wherein annular seals are disposed between the sleeve and the end members, said seals being adapted to prevent the pumped liquids laden with solid particles in the sleeve from entering to the annular space of the casing without impeding the rotation of the sleeve.

5. The motor-driven pump according to claim 4, wherein on either end of the cylindrical sleeve said annular seals comprise a seal separating the annular space from the interior of the rotary pump, and an O-ring seal subdividing the annular space into a first chamber opening onto a bearing, the first chamber being disposed in a passage of the pressurized fluid discharging from the turbine, and a second chamber being slightly overpressured with respect to the first chamber, so as to keep the pumped liquids laden with solid particles away from the bearings.

6. The motor-driven pump according to claim 1, wherein the casing elements are respectively formed with a radially outwardly extended flange on the assembled end.

7. The motor-driven pump according to claim 1, wherein the regulation means comprise adjustable blades and fixed deflectors.

8. The motor-driven pump according to claim 1, wherein the rotary pumping members comprise a hub and helical vanes which radially extend from the hub towards the sleeve.

9. The motor-driven pump according to claim 8, wherein said hub is located along the axis of the cylindrical sleeve.

10. A motor-driven pump including a turbine driven by a pressurized fluid and a rotary pump for pumping liquids and liquids laden with solid particles comprising:

a fixed pump body including two cylindrical end members which respectively constitute a suction port and a delivery port, said end members being of the same internal diameter and disposed in space relationship in line with one another;

a cylindrical sleeve having an internal diameter substantially equal to that of said two tubular parts, and being rotatably mounted in line between the tubular parts to rotate about an axis thereof;

rotary pumping members of the rotary pump being coaxially mounted inside and secured to the cylindrical sleeve;

two cylindrical casing elements being assembled together at one end thereof, and with the respective other ends fixed to the two end members, said two casing elements constituting a tubular casing for accommodating the sleeve, thereby defining an annular space between each end of the sleeve and one of the end members;

a rotor of the turbine being mounted in ring configuration around and secured to the sleeve and having at least one series of turbine vanes formed thereon, said rotor having a central portion of large diameter extending between two portions of small diameter, each said vane including a substantially radial inlet part disposed along the large diameter portion of the rotor and a substantially axially diverging outlet part disposed along one of the small diameter portions of the rotor;

injection means being disposed in ring configuration around the turbine casing and including a distribution volute secured to the casing in an easily detachable manner, said injection means including an injection inlet towards the radial inlet parts of the vanes thereby permitting a centripetal injection of the pressurized fluid into the turbine;

discharge means being disposed towards at least one of the end members and permitting a discharge of the fluid from the axial outlet parts of the vanes;

adjustable blades and fixed deflectors disposed between the distribution volute and the rotor to deviate an injection flow of the pressurized fluid toward the inlet parts of the vanes; and annular seals being disposed between the sleeve and the end members, said seals adapted to prevent the pumped liquids of particles from escaping the interior of the sleeve into the annular space of the casing without impeding the rotation of the sleeve.

11. The motor-driven pump according to claim 10, wherein the rotary pumping members comprise helical vanes extending from an internal surface of the sleeve towards the axis thereof.

12. A device for removing sediments deposited on sea, river or lake beds, mounted on a machine and intended to be submerged, comprising at least one motor-driven pump of claim 10, a strainer connected to the suction port of the motor-driven pump, at least one boom connected at its submerged end with the motor-driven pump whose axis of rotation coinciding with the axis of the boom so that the pumped materials do not undergo any axial change of direction while passing through the boom to its other end.

13. Motor-driven pump according to claim 1, wherein the rotary pumping members comprise an Archimedean screw.

14. Motor-driven pump according to claim 1, wherein the rotary pump is Moineau pump, the outer part of which is securely attached to the internal surface of the sleeve and disposed along the axis of the latter, one of the ends of the central part, engaged in the outer part, being secured by a coupling to a shaft, the other end of this shaft being attached, also by a coupling, to a bracket securely attached to the fixed pump body.

15. Motor-driven pump according to claim 10, wherein the rotary pump is a Moineau pump, the outer part of which is securely attached to the internal surface of the sleeve and disposed along the axis of the latter, one of the ends of the central part, engaged in the outer part, being secured by a coupling to a shaft, the other end of this shaft being attached, also by a coupling, to a bracket securely attached to the fixed pump body.

* * * * *